United States Patent [19]

Langen et al.

[11] 4,274,245

[45] Jun. 23, 1981

[54] CHECKOUT COUNTER

[75] Inventors: Marinus J. M. Langen, Rexdale; Edgar H. Strauss, Toronto, both of Canada

[73] Assignee: H. J. Langen & Sons Ltd., Rexdale, Canada

[21] Appl. No.: 958,429

[22] Filed: Nov. 7, 1978

[51] Int. Cl.[3] ..... B65B 5/02; B65B 5/08; B65B 67/02

[52] U.S. Cl. ..... 53/558; 53/570; 53/390

[58] Field of Search ..... 53/563, 562, 570, 558, 53/456, 390

[56] References Cited

U.S. PATENT DOCUMENTS

| | | | |
|---|---|---|---|
| 2,885,846 | 5/1959 | Harker | 53/562 X |
| 2,997,831 | 8/1961 | Neuendorf et al. | 53/570 X |
| 3,058,273 | 10/1962 | Forman et al. | 53/390 X |
| 3,382,644 | 5/1968 | Yogt | 53/563 X |
| 3,473,293 | 10/1969 | McCarthy | 53/563 |
| 3,628,632 | 12/1971 | Lambert | 53/384 X |
| 3,662,514 | 5/1972 | Goss | 53/469 |
| 3,673,765 | 7/1972 | Dohmeier | 53/570 |
| 3,715,854 | 2/1973 | Smith et al. | 53/459 |
| 3,840,092 | 10/1974 | Close | 53/384 X |
| 3,855,907 | 12/1974 | Johnson et al. | 53/570 X |
| 3,902,570 | 9/1975 | Close | 53/384 X |
| 4,068,451 | 1/1978 | Bewerse et al. | 53/390 X |

*Primary Examiner*—Horace M. Culver
*Attorney, Agent, or Firm*—Fetherstonhaugh & Co.

[57] ABSTRACT

A checkout counter for use in a retail merchant store or the like comprises a frame having a bagging station in which goods are deposited in bags, a bag making machine is located in the frame for making self supporting open bags from a web of self supporting bag making stock and a transfer mechanism is provided for transferring open bags from the bag making machine to the bagging station in an open configuration.

17 Claims, 9 Drawing Figures

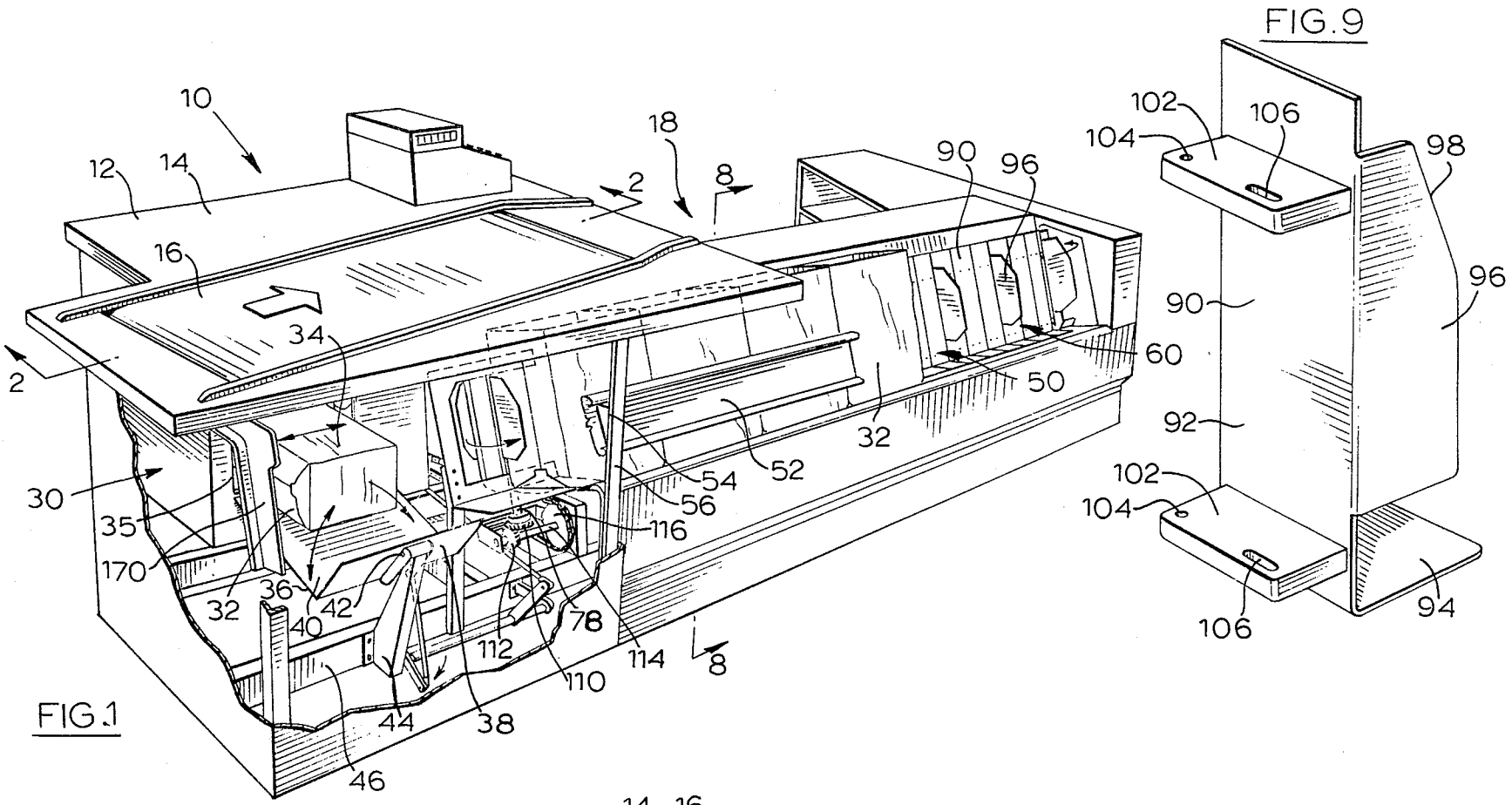
FIG.1
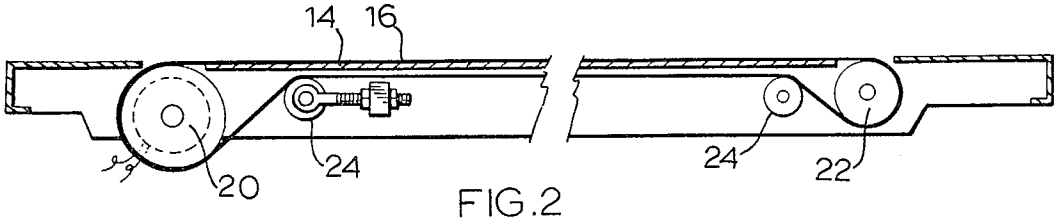
FIG.2
FIG.9

CHECKOUT COUNTER

This invention relates to checkout counters. In particular, this invention relates to a checkout counter suitable for use in the retail merchandise industry which incorporates a bag making machine.

PRIOR ART

In the operation of the most widely used checkout counters, it is customary to have a supply of ready-made bags available in a knock-down or lay-flat configuration. Paper bags and plastic bags are frequently used for the packaging of merchandise and both are generally stored in a knock-down lay-flat configuration. Paper bags have the advantage of being less expensive than plastic bags and when opened they are easier to maintain in an open configuration because they have sufficient rigidity. Plastic bags, on the other hand, are limp and must be repeatedly opened in order to admit each item.

Paper bags are normally manufactured by converters and packaged in a knock-down configuration to minimize the volume and to facilitate the handling of large quantities of bags. The bags are transported to and stored by the retail outlets in the knock-down or lay-flat configuration. While it is essential to fold or crease the bag in its manufacture in order to permit it to assume a lay-flat configuration, the creasing and folding has the disadvantage that it imparts a knock-down or lay-flat memory to the bag. Thus, even after opening of the bag the bag continues to have a tendency to collapse inwardly upon itself to lay-flat configuration. This knock-down or lay-flat memory characteristic of the bags is particularly undesirable in a checkout counter packing operation as it requires the packer to use one hand to hold the bag open while loading items into the bag with the other hand. Thus while, on the one hand, it is essential to crease the bag in order that it may assume a lay-flat configuration during shipping and packaging, the lay-flat memory which is imparted by the creasing and folding is an undesirable characteristic of a bag for use in the packing of goods in a checkout counter.

A paperboard carton is a much more convenient receptacle for use in the packing station of a checkout counter. However, cartons are impractical from the point of view of cost and the fact that an elaborate opening operation would be required. A carton would nevertheless have desirable characteristics in that it is self-supporting in an open configuration so that the packer may use both hands for loading merchandise into a carton.

In the operation of a groceteria, it is well known that the principal bottleneck in the servicing is at the checkout counter and a contributing factor to this is the time required to bag the merchandise. The difficulty in opening and maintaining the paper bags in an open configuration is a major contributor to the delays in a packaging station. As previously indicated, it is the fact that the bags have a knock-down memory which contributes to the difficulty in maintaining bags in an open configuration during the packaging operation. In some instances, two clerks are required at each checkout counter, one clerk recording sales and the other serving to load the goods into the bags. Thus, the checkout operation is a labour intensive operation and is, therefore, a costly operation. In the operation of supermarkets where only one clerk is used at each checkout counter, the entire checkout operation is slow. This results in a deterioration in customer relations and may, in fact, result in a reduction in sales volume.

From the foregoing comments it will be apparent that a great many difficulties can be traced to the fact that the paper bags which are used in checkout counters have a knock-down memory imparted by the creasing and folding required in order to minimize the space occupied by the paper bags during transportation from the converter and in storage.

While paper bags which are folded and creased to a knock-down configuration occupy a volume which is substantially less than that of the bags when open, they do nevertheless occupy a substantially greater volume than that occupied by the roll of bag forming material from which they are manufactured. Furthermore, costs are involved in the packaging and bundling of the bags into manageable units by the converter. Thus, if the operator of the groceteria could utilize the roll stock used by the converter, the storage space required for bags could be reduced and the packaging and bundling costs of the converter could be reduced. If the converter's operation could be eliminated entirely, a substantial saving in the cost of bags could be effected. This has been achieved by the checkout counter of the present invention.

The difficulties involved in setting up or opening a paper bag at a checkout counter have been known for some considerable time and numerous attempts have been made to provide bag opening machines which will open a pre-formed bag so that it is accessible to a packer. Bag opening machines do not, however, eliminate the function of the converter. In addition, the bag opening machines are constantly attempting to overcome the knock-down memory characteristics of a bag. If the bag opening machine does not correctly engage the opposite sides of a bag, the bag will collapse inwardly to its closed configuration. While bag opening machines have been previously proposed, such machines have not enjoyed any substantial degree of commercial success and it is believed that this results from the fact that the mechanisms are not totally reliable in that they lack the ability to consistently overcome the tendency of the knock-down bags to return to their lay-flat configuration.

In other previous proposals, attempts have been made to form plastic bags from a continuous web in a checkout counter. Bag-making operation in these previous proposals has been one in which a web of plastic material is folded lengthwise and is heat sealed at longitudinally spaced intervals to divide the web into a series of compartments, the web being subsequently severed along the seal lines in order to separate individual bags from the web. The compartments formed by the heat sealing operation are loaded with goods before the bags are severed from the continuous web. Again, considerable difficulty is experienced in attempting to maintain the sides of the web on each side of the compartment in a spaced relationship and a bag opening mechanism is required in order to maintain the bag in the open configuration.

The difficulties of the prior art described above have been overcome by mounting a bag-making machine, which is adapted to make self-supporting open bags from a web of self-supporting bag making material, in the checkout counter and providing transfer means for transferring open bags from the machine to the bagging station in an open configuration. The manufacture of bags in an open configuration and the transfer of the bags to the bagging station in the open configuration overcomes all of the problems which are inherent in the knock-down bag usage.

The bagging operation is further improved by the provision of a bagging station in the checkout counter which is adapted to support the open bags in a generally upright configuration.

The bagging operation may be further improved by the provision of a moving conveyor in the bagging station for moving bags through the bagging station in an open configuration.

SUMMARY OF INVENTION

According to one aspect of the present invention, a checkout counter comprises a frame having a bagging station, a bag-making machine in said frame for making a self-supporting bag-making stock, and transfer means for transferring an open bag from said bag-making machine to said bagging station in an open configuration.

According to a further aspect of the present invention, the checkout counter has a bagging station which is adapted to support an open bag in a generally upright configuration.

According to yet another aspect of the present invention, the bagging station has a bag support ledge extending longitudinally thereof which is arranged to support a bag in a manner such that the weight of the bag will urge the bag inwardly of the support ledge.

According to a further aspect of the present invention, a conveyor is mounted on the checkout counter and extends longitudinally through the bagging station along the support ledge. The conveyor is operable to drive open bags longitudinally of the support ledge.

According to yet another aspect of the present invention, the bag-making machine is arranged to discharge an open bag therefrom and which is oriented in a generally horizontal configuration such that the open end thereof opens laterally therefrom, the transfer means being adapted to re-orient the bag to a generally upright configuration as it is discharged from the bag-making machine and to transfer the bag to the bagging station in the open upright configuration.

The invention will be more clearly understood after reference to the following detailed specification read in conjunction with the drawings wherein FIG. 1 is a pictorial front view of a checkout counter, partially broken away, in order to illustrate the transfer mechanism;

FIG. 2 is a sectional view of the counter top along the line 2—2 of FIG. 1;

FIG. 9 is a detail view of an L-shaped segment of the transfer conveyor.

Figure 3:
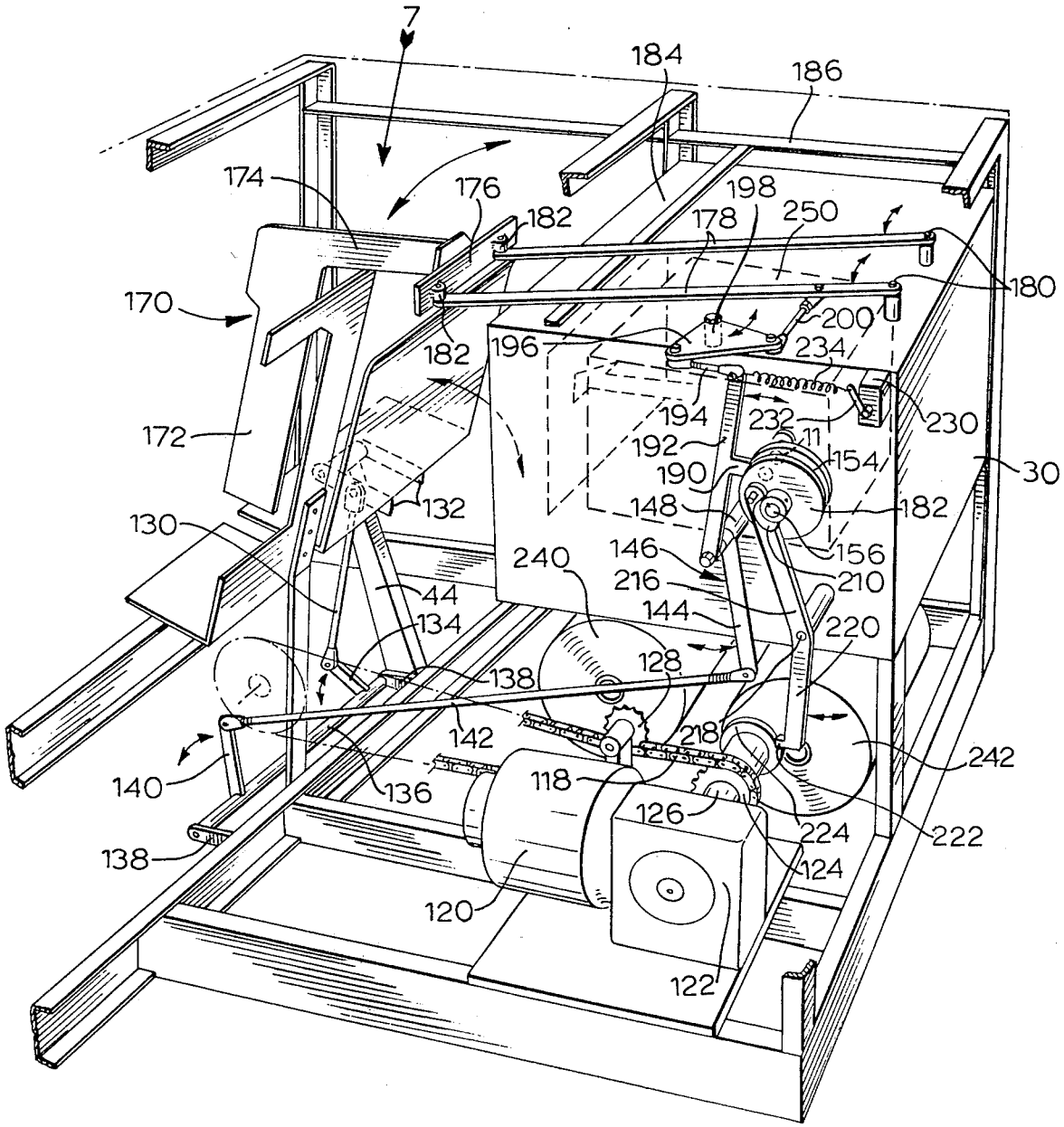
FIG. 3 is a pictorial view of the transfer mechanism for transferring bags from the bag-making machine to the bag support conveyor.

With reference to FIG. 1 of the drawings, reference numeral 10 refers generally to a checkout counter of the type commonly used in a groceteria or the like. The checkout counter comprises a housing or counter enclosure generally identified by reference numeral 12. The housing has an upper face 14 along which a moving conveyor belt 16 extends from a receiving end to the bagging station 18. The conveyor 16 is of a conventional construction extending around a driven roller 20 at one end thereof and a support roller 22 at the other end thereof with tension applied thereto by means of tensioning rollers 24.

A bag-making machine 30 is mounted within the housing 12. The bag-making machine is preferably of the type described in my U.S. Pat. No. 4,184,413, issued Jan. 22, 1980, the specification of which is incorporated herein by reference in its entirety. The bag-making machine 30 manufactures open bags 32 which are creased along longitudinal crease lines 34 so that the bag has a memory which serves to maintain the bag in an open configuration. Thus when the bags are discharged from the bag-forming machine, they retain their open configuration. The bag-making machine 30 is arranged so that the discharge opening 35 thereof is disposed above the transfer platform 36.

The transfer platform 36 is generally L-shaped and has base wall 38 and side wall 40. The platform 36 is pivotally mounted at hinge 42 to a support arm 44, the other end of which is mounted on a longitudinally extending frame member 46. As will be described hereinafter, the platform 36 is movable between the receiving position shown in FIG. 1 and the discharge position shown in FIG. 3 of the drawings. When the receiving position shown in FIG. 1 of the drawings, the platform 36 is spaced below the discharge opening 35 of the bag-forming machine so that when a bag is discharged from the bag-making machine, it will fall under its own weight onto the platform. As shown in FIG. 1, the side wall 40 extends to a point closely adjacent the discharge opening 35 of the bag-forming machine.

In order to support the bags in their open configuration in the bagging station, a ledge generally identified by the reference numeral 50 extends logitudinally through the bagging station. The ledge provides a bottom support wall and a side support wall and is inclined inwardly from the vertical plane toward the counter so that the weight of the bags and their contents tend to urge the bags inwardly toward the counter so that they are substantially self-supporting on the platform. In order to prevent the accidental lateral displacement of the bags from the counter before they are loaded, a support rail 52 has one end secured at 54 to an upright frame member 56 and extends in a spaced parallel relationship with respect to the ledge 50.

The bar 52 terminates at a point about one bag width into the loading station so that the bags will be at least partially loaded before they move longitudinally beyond the end of the support bar 52. After partial loading of the bags, the weight of the contents serves to maintain the bags on the ledge.

Figure 7:
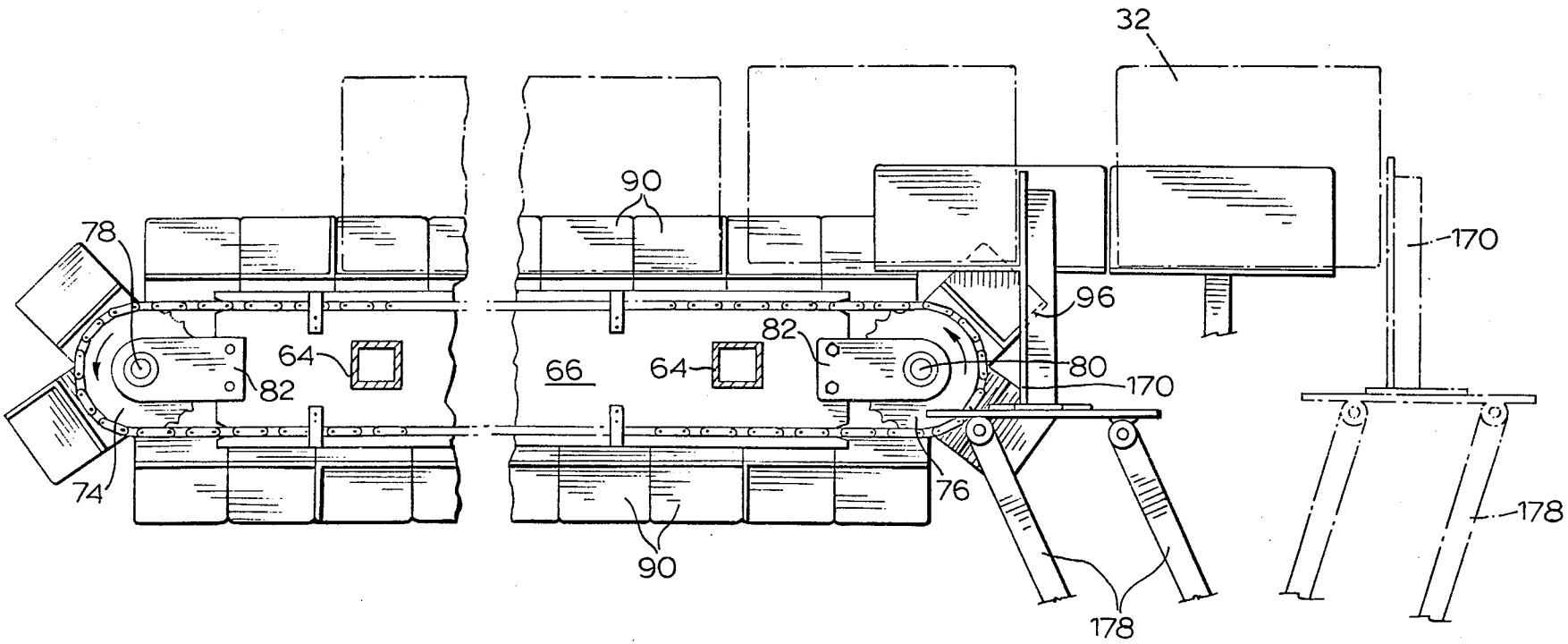
FIG. 7 is a top view illustrating the transfer mechanism and conveyor mechanism in the direction of the arrow 7 of FIG. 3.
Figure 8:
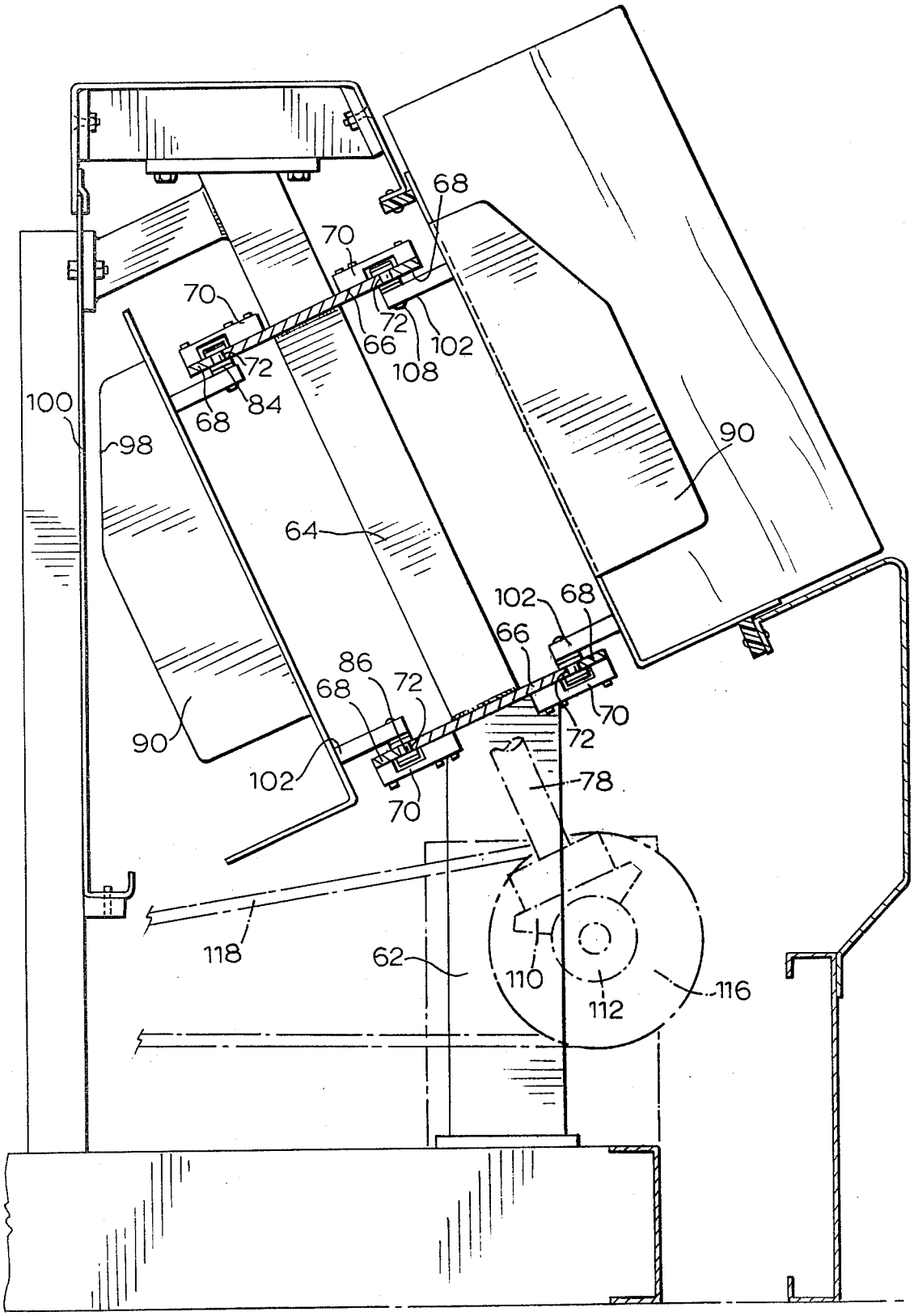
FIG. 8 is a sectional view in the direction of the arrows 8—8 in FIG. 1.

A conveyor mechanism 60 serves to transport the bags through the bagging station. The conveyor mechanism 60 is best illustrated in FIGS. 7 and 8 of the drawings to which reference is now made. As shown in FIGS. 7 and 8 of the drawings, the frame of the checkout counter includes vertical support posts 62 (only one of which is shown), each of which supports angularly inclined posts 64. Guide plates 66 are mounted on the posts 64 and extend normal thereto. The guide plates 66 have guide rails 68 extending longitudinally of the side faces thereof and spaced therefrom by support brackets 70 to form chain slipways 72. Drive sprockets 74 and 76 are mounted on shafts 78 and 80, respectively, which are mounted on support brackets 82 arranged at opposite ends of the support plates 66. It will be understood that two drive sprockets 76 are located on the shaft 80 and two drive sprockets 74 are located on the shaft 78. Chains 84 and 86 are arranged one above the other and extend around sprockets 74 and 76.

A plurality of L-shaped segments 90 are mounted on the chains 84 and 86 in a side by side relationship. The L-shaped segments 90 are best illustrated in FIG. 9 of the drawings wherein it will be seen that each segment includes a back support panel 92 and a bottom support panel 94. The segment illustrated in FIG. 9 of the drawings also has a pusher blade 96 which projects forwardly from the back support panel 92. It will be apparent from FIG. 1 of the drawings that every third L-shaped segment 90 is provided with a pusher plate 96. A sufficient space is provided between each successive pusher plate 96 to permit a bag 32 to be located therebetween. It will be noted that the outer edge of the pusher plate 96 has an angularly inclined portion 98 which serves to provide clearance with the back wall 100 of the checkout counter as shown in FIG. 8 of the drawings so that the width of the checkout counter can be maintained to a minimum. Each segment 90 has a pair of mounting brackets 102 projecting rearwardly therefrom. Each mounting bracket has a passage 104 at one end thereof and an elongated slot 106 at the other end thereof. Elongated pins 108 project outwardly from the chains 84 and 86 and extend through passages 104 and 106. The passage 106 is elongated to permit movement of its associated pin 108 so that the chain can negotiate the curved portion of its path extending around sprockets 74 and 76.

As shown in FIGS. 1 and 8 of the drawings, the conveyor mechanism 90 is driven by rotatably driving the shaft 78 through bevelled gears 110 and 112. The bevelled gear 112 is mounted on a drive shaft 114 which is driven by a sprocket 116 which is in turn driven by a drive chain 118 (FIG. 3). The drive chain 118 is driven by the main drive motor 120 through a reduction gear box 122 and a sprocket 124 mounted on the output drive shaft 126. A chain tensioning sprocket 128 is provided for maintaining the required tension in the chain 118.

The mechanism which controls the movement of the platform 36 will now be described with reference to FIGS. 1, 3, 5 and 6 of the drawings. As previously indicated, the platform 36 is pivotally mounted at 42 on the arm 44. A connecting rod 130 connects a bracket 132 which is mounted on the base plate 38 of the platform to a lever arm 134 which projects outwardly from a shaft 136. The shaft 136 is mounted to pivot in brackets 138 which are located at opposite ends thereof. A second lever arm 140 projects radially outwardly from the shaft 136 and has its outer end connected to one end of a connecting rod 142. The other end of the connecting rod 142 is connected to one arm 144 of a rocker arm generally identified by the reference numeral 146. The rocker arm 146 (FIG. 5) is pivotally mounted on a pivot pin 151 and has a second arm 148 projecting outwardly therefrom. A cam follower 150 is located at the outer end of the arm 148. The cam follower 150 is positioned in a cam track 152 which is formed in a cam plate 154. The cam track has four distinct camming surfaces extending through arcs A1, B1, C1 and D1. The cam plate 154 is keyed to a shaft 156 by means of a locking key 158. The shaft 156 is connected to the main drive shaft of the bag-making machine 30 and is rotatably driven when the bag-making machine 30 is activated to manufacture a bag. The cam plate 154 is rotatably driven in the direction of the arrow 160 by the shaft 156. When the cam follower 150 is located at the position shown in FIG. 5 at the beginning of the arc A1, the platform 36 is located in the receiving position illustrated in FIG. 1 of the drawings. Rotation of the cam plate 154 over the arc A1 causes the platform 36 to be elevated to the discharge position in alignment with the platform 60. Rotation over the arc B1 retains the platform in the elevated position and rotation over the arc C1 lowers the platform to the receiving position, again shown in FIG. 1 of the drawings. Rotation over the arc D1 retains the platform in the lowered or receiving position.

Figures 4, 5, 6:
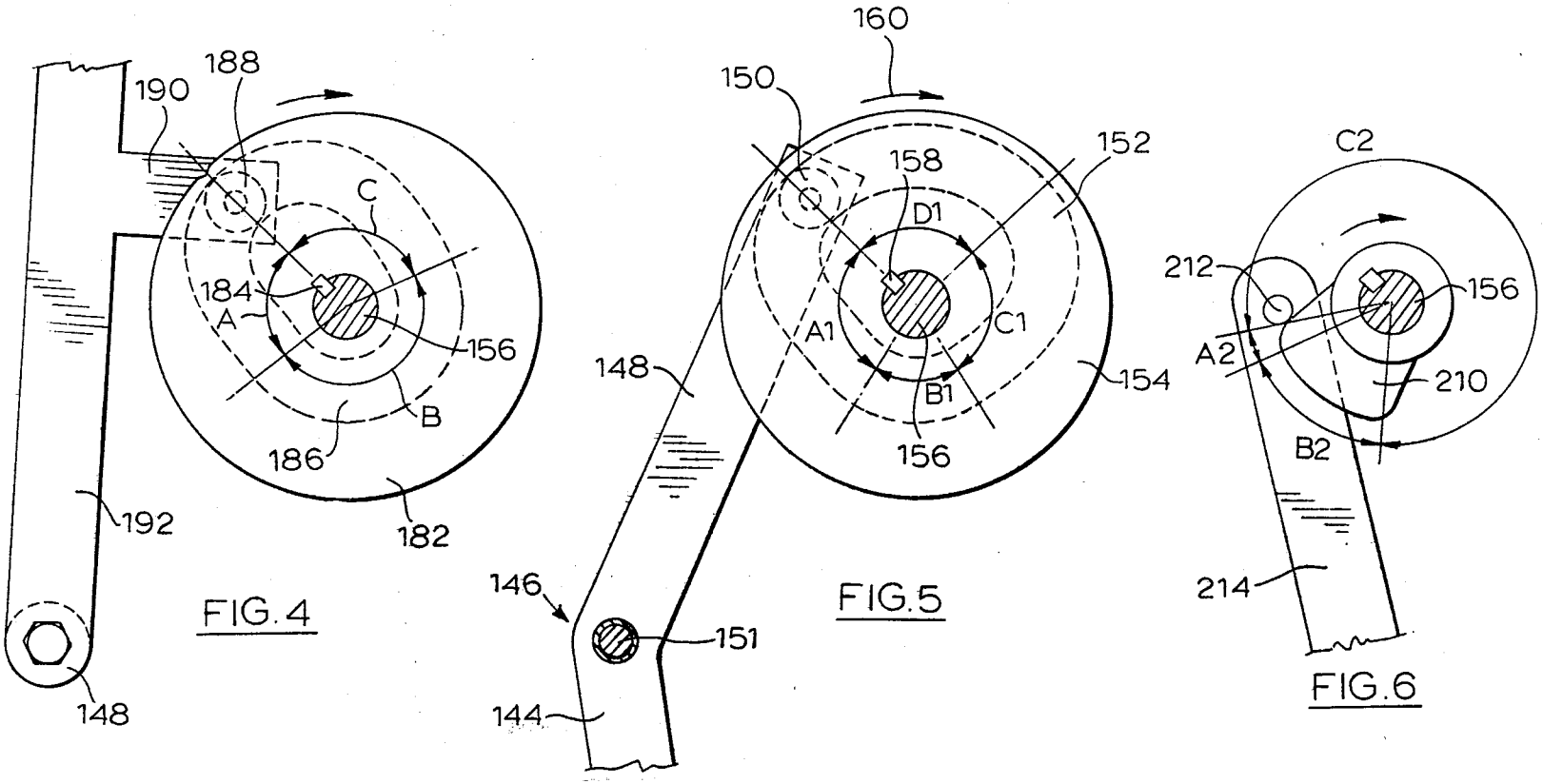
FIG. 4 is a side view of a control cam for controlling the operation of the transfer mechanism.
FIG. 5 is a side view of a second cam for use in controlling the operation of the transfer mechanism.
FIG. 6 is a side view of a dog clutch cam for use in the control of the timing of the transfer mechanism.

The transfer mechanism also includes a lateral shift mechanism for moving the bags from the platform onto the conveyor. The lateral shift mechanism is best illustrated in FIGS. 3 and 7 of the drawings. The lateral shift mechanism includes an L-shaped blade member 170 which has a section 172 extending in a plane which is parallel to the plane of the side support wall 40 of the platform when the platform is located in the elevated position. The L-shaped member 170 also has an arm 174 projecting inwardly to a bracket 176, on which it is securely mounted. The bracket 176 is supported on a parallelogram linkage 178. The inner ends of the linkage 178 are pivotally mounted at 180, with the outer ends thereof pivotally mounted at 182 on the bracket 176. A support bar 184 underlies and supports the parallelogram linkage arms 178. The support bar 184 is in turn supported by the transverse frame member 186 and a second transverse frame member (not shown) so that it supports a major component of the weight of the pusher arm. The parallelogram linkage 178 is driven, as will be described hereinafter, between a first and second position to move the pusher plate 170 between the retracted position shown in broken lines in FIG. 7 and the advanced position shown in solid lines in FIG. 7 so that it may engage a bag 32 and move the bag longitudinally of the platform onto the support ledge. The parallelogram linkage arms 178 are driven by power supplied through the drive shaft 156 which, as previously indicated, is a power output shaft of the bag-making machine 30. A cam 182 is keyed to shaft 156 by a key 184 (FIG. 4). The cam 182 has a cam track 186 formed with three different cam sections A, B and C. The cam follower 188 is mounted for movement along the cam track 186 and is supported by an arm 190 which projects outwardly from a lever arm 192. One end of the lever arm 192 is mounted on the shaft 148 and the other end of the arm 192 has a connecting rod 194 connected thereto. The connecting rod 194 (FIG. 3) is connected to a lever plate 196. The lever plate 196 is pivotally mounted on a support shaft 198 and is connected to parallelogram link arms 178 by a connecting rod 200.

In the operation, rotation of the shaft 156 from the position shown in FIG. 4 over the arc A causes the parallelogram link mechanism to move the transfer blade 170 from the position shown in solid lines in FIG. 7 to the retracted position shown in chain lines in FIG. 7. Further rotation through the arc B serves to retain the transfer plate 170 in the retracted position and rotation through the arm C moves the transfer plate 170 from the retracted position to the advanced position shown in FIG. 7.

The operation of the bag-making machine and the transfer mechanism is cyclic such that in one complete cycle a bag is manufactured by the bag-making machine while the bag which was previously manufactured is transferred to the conveyor and indexed along the conveyor a distance equal to the width of one bag. The operation of the bag-making machine and the transfer mechanism and conveyor is limited to one cycle for each demand signal by a cam 210 (FIG. 3) which is mounted on shaft 156. The cam 210 has operating arcs A2, B2 and C2 which perform distinctly different functions. A follower 212 is located at the end of the arm 214 of a rocker arm 216 which is pivotally mounted on a pivot pin 218. The arm 220 at the other end of the rocker arm 216 has a shoulder 222 which engages a corresponding shoulder on clutch plate 224.

Rotation of the shaft 156 from the position shown in FIG. 6 of the drawings effects a rapid release of the clutch during rotation over the arc A2. Further rotation over the arc B2 retains the shoulder 222 out of engagement with the clutch 224 to permit a plurality of rotations of the shaft 126 on which the clutch plate 224 is keyed. Thereafter, during rotation over the arc C2, the shoulder 222 is urged inwardly to interrupt the power supply to the transfer mechanism by engagement with the corresponding shoulder formed in the clutch plate 224.

The number of bag-making operations carried out by the bag-making machine is counted by a counter 230 (FIG. 3) which has an operating arm 232 connected by a spring 234 to lever arm 192.

In use, two rolls of paper stock 240 and 242 are mounted in the housing on suitable unwinding support shafts and the web from the first roll 242 is fed to the bag-making machine. The power is supplied to activate the main drive motor 120 of the bag-making machine to drive the main drive shaft 156 through a chain and sprocket arrangment (not shown) which drivingly connects the shaft 126 and shaft 156 as described in our U.S. Pat. No. 4,184,413, dated Jan. 22, 1980. The power supply being controlled by a foot pedal operated by the packer at the checkout counter. The bag-making machine 30 will then operate to manufacture a bag by forming the web around the square mandrel 250 and sealing the web to the required bag-forming configuration and severing the bag forming length of web from the continuous web. The transfer mechanism will have operated through one complete cycle simultaneously with the operation of the manufacture of the bag. However, because a bag was not previously manufactured, no actual transfer will have taken place. The operation of the bag-making machine is now interrupted with a bag having been manufactured and ready for discharge. The transfer mechanism is located in the position in which the transfer platform 36 is in the receiving position illustrated in FIG. 1 of the drawings. The operator again actuates the control panel and the bag which was previously manufactured begins its discharge from mandrel 250 onto the transfer platform. Simultaneously, the web which is unwound from roll stock 242 begins to move along the guide path formed around the mandrel 250. Thus, while a bag is being dicharged from the bag-making machine the bag-making machine is simultaneously operating to produce the next bag. Operation of the bag-making machine causes rotation of the main drive shaft 156 and its associated cam 154, 182 and 210. At the beginning of each transfer cycle, the platform 36 is located in the receiving position illustrated in FIG. 1, as previously described, and the transfer blade 170 is located in the position shown in FIG. 1 and in chain lines in FIG. 7 in which it is spaced outwardly from the transfer platform on the opposite side thereof to the transfer conveyor mechanism. Rotation of the drive shaft 156 serves to control the operation and timing of the movement of the transfer platform through cam 154, the transfer blade 170 through cam 182, and the conveyor 50 through cam 210. As previously described, operation of the cam 154 through one complete rotation causes the platform to be elevated from the position shown in FIG. 1 to the position shown in FIG. 3, the platform being maintained in the elevated position while the transfer pusher blade 170 is activated to move laterally across the platform to drive a bag onto the conveyor platform which is being simultaneously driven lengthwise. It will be noted from FIG. 7 of the drawings that the timing of the forward movement of the conveyor is such that the pusher plate 96 remains out of the chute line of the discharging bag at least until the transfer blade 170 is withdrawn.

From the foregoing it will be apparent that the checkout counter of the present invention incorporates a bag-making machine and appropriate transfer mechanisms for manufacturing a bag and transferring the bag in an open configuration to a packing station. The method of manufacture of the bag and its transfer is such that the bag is not pre-formed with any crease lines which impart a knock-down memory to the structure of the bag with the result that the bag has an inherent tendency to assume an open configuration and to remain in an open configuration at all times. This greatly facilitates the loading of the bag at the checkout counter station. In addition, it will be noted that bags are made in the checkout counter from roll stock, thereby overcoming the problems previously encountered in storing large quantities of knock-down paper bags. These and other advantages of the apparatus of the present invention will be apparent to those skilled in the art.

What I claim my invention is:

1. A checkout counter comprising, (a) a housing having a compartment formed therein, a counter top formed on the housing, a bagging station opening outwardly from the housing and a transfer passage extending from said compartment to said bagging station, (b) a bag-making machine in said compartment adapted to make a self-supporting open bag within said compartment, (c) transfer means arranged to engage an open bag located within said compartment and transfer it in the open configuration from said compartment through said transfer passage into said bagging station in an upright upwardly open self-supporting configuration.

2. A checkout counter as claimed in claim 1 wherein said bagging station is adapted to support an open bag in a generally upright configuration.

3. A checkout counter as claimed in claim 1 wherein a bag supporting ledge extends longitudinally of said bagging station, said ledge having a bottom wall and a wide wall arranged to underlie a bottom wall and side wall, respectively, of an open bag to support a bag in said bagging station.

4. A checkout counter as claimed in claim 3 wherein the bottom and side wall are angularly inclined with respect to the horizontal and vertical planes, respectively, such that the weight of the bag will urge the bag inwardly of the ledge toward the side wall.

5. A checkout counter as claimed in claim 4 wherein the support ledge has a longitudinal extent which is at least twice the maximum width of said open bag whereby a plurality of bags can be supported on said ledge at the same time.

6. A checkout counter as claimed in claim 5 wherein said support ledge extends along one side of said frame of said counter into and through said bagging station.

7. A checkout counter as claimed in claim 6 including a conveyor mounted on said frame and extending longitudinally through said bagging station, said conveyor being operable to drive open bags longitudinally of said support ledge.

8. A checkout counter as claimed in claim 7 wherein said conveyor has a side run and bottom run extending along said side wall and said bottom wall respectively of said support ledge.

9. A checkout counter as claimed in claim 8 wherein said conveyor comprises a plurality of L-shaped segments mounted in a side-by-side relationship on an endless conveyor drive member.

10. A checkout counter as claimed in claim 9 wherein at least some of said segments have a pusher arm projecting outwardly therefrom to extend laterally of said support ledge as said segments are driven along said support ledge, said pusher arms engaging bags located on said support ledge to provide a positive drive for conveying bags along said support ledge.

11. A checkout counter as claimed in claim 8 wherein said conveyor extends around first and second supports disposed at first and second ends of said support ledge respectively, said supports having an axis of rotation extending parallel to said side wall of said support ledge.

12. A checkout counter as claimed in claim 3 including a bag support spaced outwardly from and opposite said side wall over at least a first portion of the length of said support ledge for preventing accidental lateral displacement of bags from said support ledge during bag loading.

13. A checkout counter as claimed in claim 1 wherein said bag-making machine is arranged to discharge an open bag therefrom which is oriented in a generally horizontal configuration such that the open end thereof opens laterally therefrom, said transfer means being adapted to re-orient the bag to said generally upright configuration as it is discharged from said bag making machine and transferred to said bagging station.

14. A checkout counter comprising, (a) a housing having an upper face, a receiving end, a back end and a front side and a back side, said housing having an enclosed chamber formed therein, (b) a support ledge extending longitudinally of said front side of said counter from a first point spaced rearwardly from said receiving end to a second point adjacent the back end of said housing, said support ledge having a bottom wall and a side wall arranged to underlie a bottom and side wall of an open bag to support an open bag in an upwardly opening upright configuration for loading, (c) transfer passage means opening from said chamber to said support ledge at said first point, (d) a bag-making machine mounted in said chamber, said bag making machine being adapted to make a self-supporting bag from a continuous web of bag-making stock, said bag making machine having a discharge end from which a bag is discharged, bottom first, in a generally horizontal plane, the discharge end being spaced laterally inwardly from the plane of said side wall of said support ledge and forwardly from said support ledge, (e) transfer means operable to receive a generally horizontally oriented open bag discharged from said discharge end of said bag-making machine and to re-orient the bag to a generally upright configuration and deposit the bag on said support ledge in an upwardly opening configuration.

15. A checkout counter as claimed in claim 14 wherein said transfer means comprises a platform having a base wall and a side wall, each having an outer end, said platform being mounted to pivot about a first axis for movement between a first position disposed adjacent said support ledge with said side suppport wall and said base support wall aligned with said bottom wall and said side wall of said support ledge respectively to permit upright bags to slide transversely from said platform onto said support ledge and a loading position in which said side support wall extends toward said bag making machine at a level below said discharge end to underlie a side of a bag as it is discharged from said bag making machine and said base support wall being disposed outwardly from and opposite said discharge opening to act as a stop limiting travel of a bag in a direction away from said discharge opening, and a discharge arm mounted in said housing for movement along said platform in a direction toward said first point for moving a bag located on said platform onto said support ledge, and drive means for driving said platform between said first and second positions.

16. A checkout counter as claimed in claim 15 wherein said support platform is pivotally mounted about a first axis disposed adjacent the outer edge of said base wall such that when said platform is in said second position, said base wall extends below the plane of said bottom wall of said support ledge and said side support wall of said platform is inclined downwardly from said discharge opening of said bag making machine to said base wall whereby bags discharging from said bag-making machine are free to fall under their own weight toward said base support wall, said platform pivoting about said first axis in moving to said second position to elevate said base support wall and said side support wall into alignment with said support ledge.

17. A checkout counter comprising, (a) a frame having a bagging station, (b) a bag-making machine in said frame for making a self-supporting open bag from a web of self-supporting bag-making stock;

(c) transfer means for transferring an open bag from said bag-making machine to said bagging station in an open configuration;

(d) said bag-making machine being arranged to discharge an open bag therefrom which is oriented in a generally horizontal configuration such that the open end thereof opens laterally therefrom, said transfer means being adapted to re-orient the bag to said generally upright configuration as it is discharged from said bag-making machine and transferred to said bagging station;

(e) a bag supporting ledge extending longitudinally of said counter in said bagging station, said ledge having a bottom wall extending in a generally horizontal first plane and an upright side wall extending in a second plane, said bottom and side walls being arranged to underlie a bottom and side wall of a bag respectively to support an open bag in an upwardly opening upright configuration, said ledge having an input end disposed adjacent said bag-making machine;

(f) said bag-making machine being laterally spaced to one side of said input end of said support ledge and having a discharge end opening toward said second plane of said upright wall;

(g) said transfer means comprising a platform having a base wall and a side support wall arranged to support the bottom wall and a side wall of a bag, said platform being mounted to pivot about a first axis between a discharge position in which said platform is disposed adjacent said input end of said support ledge in which said side support wall and said base support wall are aligned with said upright side wall and said bottom wall of said support ledge, respectively, and a loading position in which said side support wall extends toward and underlies said discharge end of said bag-making machine and said base wall is disposed outwardly from and directed toward said discharge end, drive means for driving said platform to and fro between said discharge and loading positions, and means for engaging a bag located on said platform in said discharge position and moving said bag to the input end of said support ledge.

* * * * *